US005313678A

United States Patent [19]

Redewill

[11] Patent Number: 5,313,678

[45] Date of Patent: May 24, 1994

[54] ACOUSTICAL PILLOW

[76] Inventor: Frances H. Redewill, 24352 Acaso #7, Laguna Hills, Calif. 92656

[21] Appl. No.: 2,134

[22] Filed: Jan. 8, 1993

[51] Int. Cl.[5] ..... A47G 9/00; H04R 5/02

[52] U.S. Cl. ..... 5/639; 5/642; 5/636; 5/904; 297/393; 381/24; 381/90; 381/188; 381/205

[58] Field of Search ..... 5/639, 640, 642, 636, 5/637, 904; 297/393; 381/24, 87, 88, 90, 183, 187, 188, 205

[56] References Cited

U.S. PATENT DOCUMENTS

| | | | |
|---|---|---|---|
| D. 311,472 | 10/1990 | Giles | D6/601 |
| 1,712,158 | 5/1929 | Neal . | |
| 1,864,615 | 6/1932 | Quinby . | |
| 2,059,588 | 11/1936 | Kuhn . | |
| 2,512,641 | 6/1950 | Halstead . | |
| 2,589,155 | 3/1952 | Smith | 5/637 |
| 2,795,161 | 6/1957 | Weinman . | |
| 2,958,769 | 11/1960 | Bounds . | |
| 3,290,450 | 12/1966 | Majoros . | |
| 3,384,719 | 5/1968 | Lanzara . | |
| 3,480,976 | 12/1969 | Yavner | 5/639 |
| 3,621,155 | 11/1971 | Pruitt . | |
| 3,946,316 | 3/1976 | Hough . | |
| 4,019,727 | 4/1977 | Martin et al. | 5/636 |
| 4,038,499 | 7/1977 | Yeaple . | |
| 4,447,922 | 5/1984 | Brochu | 5/640 |
| 4,782,533 | 11/1988 | Haynie | 381/188 |
| 4,797,934 | 1/1989 | Hufnagel | 297/401 |
| 4,841,487 | 6/1989 | Carter | 5/420 |
| 4,862,438 | 8/1989 | Fry | 381/188 |
| 4,972,533 | 11/1990 | Brown | 5/413 |
| 4,991,222 | 2/1991 | Nixdorf | 381/188 |
| 5,072,429 | 12/1991 | Mair | 5/639 |
| 5,123,133 | 6/1992 | Albert | 5/639 |
| 5,185,807 | 2/1993 | Bergin et al. | 381/183 |
| 5,220,700 | 6/1993 | Liu | 5/640 |

*Primary Examiner*—Alexander Grosz
*Attorney, Agent, or Firm*—Richard L. Myers

[57] ABSTRACT

A pillow adapted to support the head of a user includes a core having an axis extending through a central section and opposing end sections. The central section has a thickness adapted to support the head of a user and a length generally equivalent to the width of the user's head. The end sections are bent from the central section and are generally coextensive in a common direction to provide the core with a U-shaped configuration. Portions of the core define a slit extending into the core and a spring is disposed in the slit to extend through the central section and into each of the end sections. The spring has properties for biasing the end sections toward each other to provide a snug fit relationship with the ears of the user and thereby attenuate environmental sound. Speakers can also be placed in the slit to accommodate transmission of audio sound to the ears of the user. The pillow can be provided with a pillow case surrounding the core and a tote bag permanently attached to the pillow case. The tote bag has a stored position within the pillow case and a tote position everted from the pillow case for carrying the pillow. A method for carrying the pillow includes the step of everting the tote bag over the pillow and pillow case to carry the pillow.

9 Claims, 4 Drawing Sheets

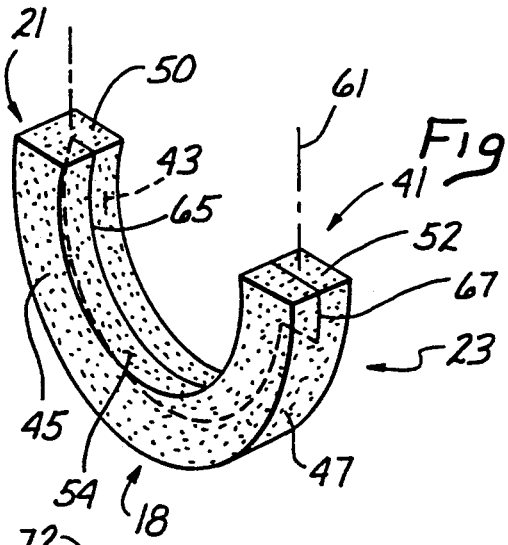
Fig. 2a
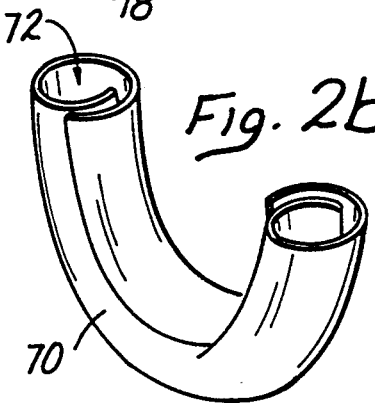
Fig. 2b
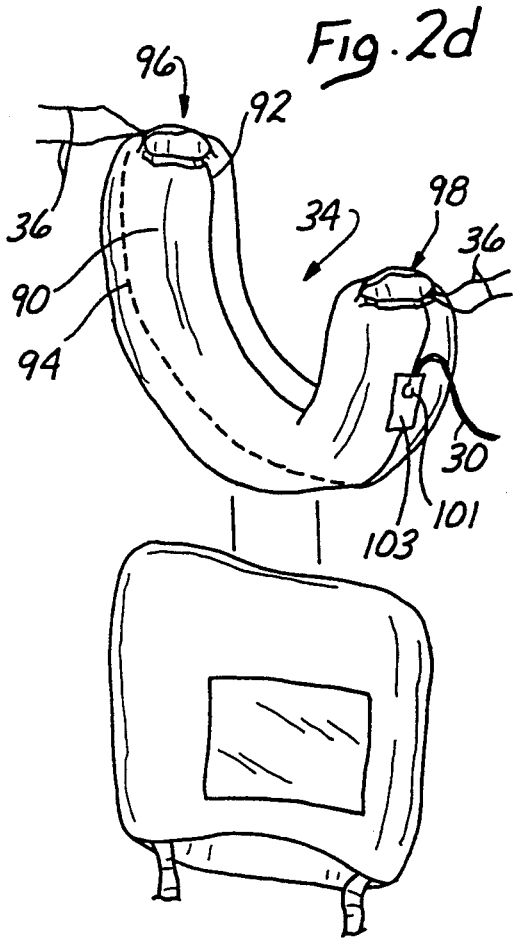
Fig. 2d
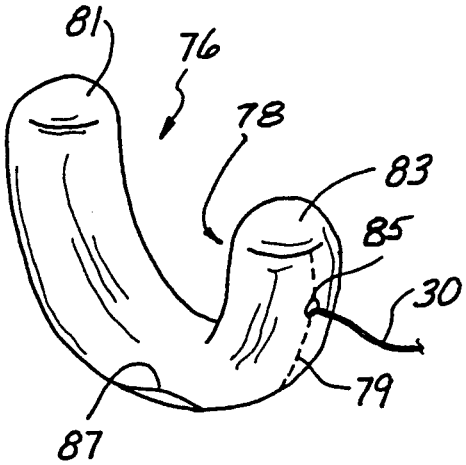
Fig. 2c
Fig. 2e

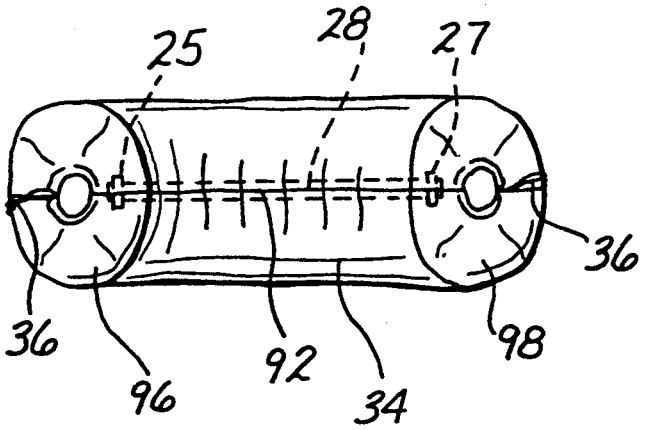
Fig. 5
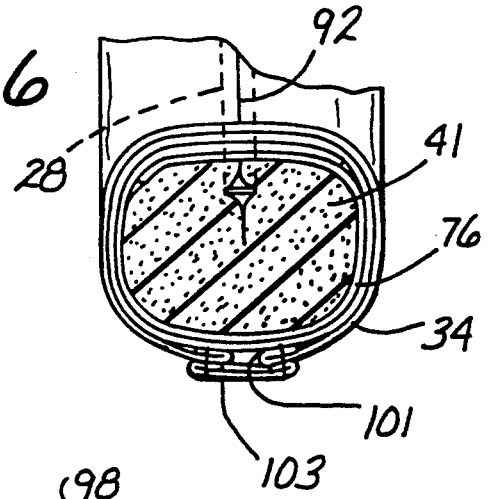
Fig. 6
Fig. 7
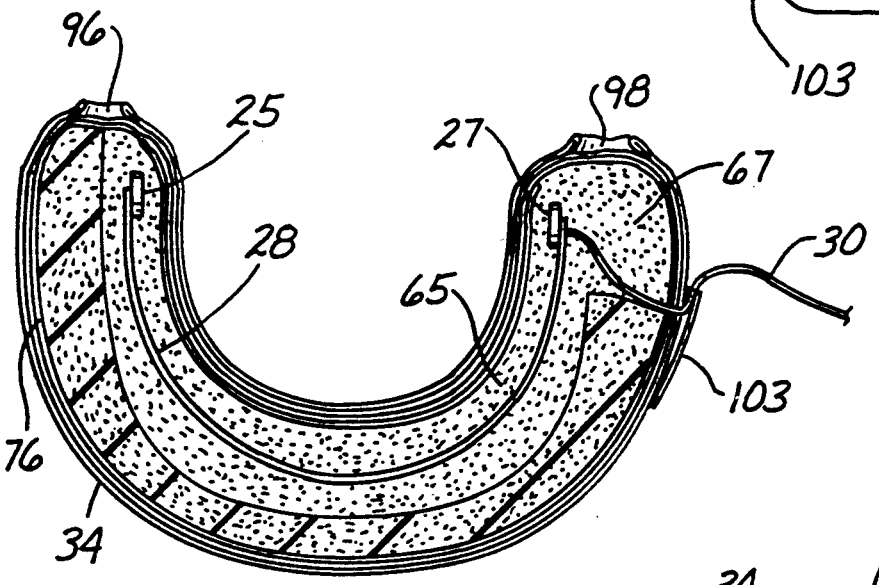
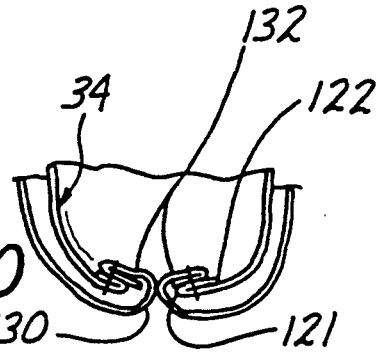
Fig. 10

ACOUSTICAL PILLOW

BACKGROUND OF THE INVENTION

This invention relates generally to pillows and more specifically to speaker pillows which are adapted to support the head of the person lying thereon.

DISCUSSION OF THE PRIOR ART

When a person is resting, it is desirable to support his head in a natural state with as little pressure applied to the head as possible. Pillows are commonly used for this purpose. In pursuit of that objection pillows have been adapted not only to elevate the head of the user but also to provide a soft surface which increases the area of contact and therefore decreases the pressure on the head and neck of the user.

Particularly when one is attempting to rest in a noisy environment, such as on an airplane, it is desirable to attenuate the noise which of course is counterproductive to sleep. Earplugs are commonly used for this purpose. In order to be effective, such earplugs must be lodged with considerable force within the ear canal. This force, particularly when applied over a long period of time can be sufficiently objectionable that it also is counterproductive to sleep.

It may also be desirable while resting to produce sound at a very low level to sooth the user or perhaps aid in self-hypnosis or subliminal suggestion. Audio headsets having a speaker for each ear are sometimes used in conjunction with audio tapes or cassette disks for this purpose. Where these headsets are used in a noisy environment, the sound from the headsets must be elevated in order to be audible over the background noise. When so elevated, the audio sound may also be audible to others who often find the sound objectionable.

SUMMARY OF THE INVENTION

An acoustical pillow of the present invention overcomes these shortcomings of the prior art. It includes an elongate pillow having a core which extends along an axis through a central section and into opposing end sections. In use, the central section elevates and softly supports the head of the user thus functioning as an orthopedic cervical pillow which allows the spine to rest correctly and comfortably.

The end sections are bent from the central section and extend to snugly engage the sides of the head thereby supporting the head in an upright position which is squared with the shoulders of the user. With the end sections of the pillow configured to snugly engage the ears of the user, these sections attenuate any environmental noise which may otherwise interfere with sleep. A pair of speakers can also be provided in the end sections of the pillow where they are positioned to be closely spaced to the ears of the user.

A preferred embodiment includes a spring which extends through the sections of the pillow and biases the end sections into the snug fit relationship with the ears of the user. In this embodiment the spring performs several functions. First, it aids in supporting the head of the user in a squared relationship with the shoulders. Second, it facilitates isolation of the ears of the user from environmental noise. Third, it aids in maintaining the speakers in a closely spaced relationship to the ears of the user thereby facilitating communication of the audio sound. With the end sections of the pillow attenuating environmental sound and the speakers placed in close proximity to the user's ears, the audible sound from the speakers can be maintained at a lower level which does not interfere with the privacy of others.

In a preferred embodiment the pillow includes a tote bag which can be stored within a pillow case during normal use, but which can be everted from the pillow case to enclose the pillow. A strap associated with the tote bag facilitates portability of the acoustical pillow.

In one aspect of the invention, the speaker-pillow is adapted to support the head of a user and includes a core having an axis and a longitudinal surface extending between opposing end sections. The axis is bent so that the end sections extend in a common direction. A pair of speakers are disposed in the end sections and adapted to face each other in close proximity to the user's ears. A spring is disposed to extend into the end sections for biasing these sections into a snug fit relationship with the ears of the user. A pillow cover surrounds the pillow and an electrical cord extends from each of the speakers through the pillow cover for connection to an audio source.

In another aspect of the invention, the pillow does not include speakers but the spring is included for biasing the end sections against the ears of the user to attenuate environmental sound.

In a further aspect of the invention, the end sections in snug engagement with the ears of the user provide means for facilitating introduction of audio sound from the speakers while inhibiting communication of undesirable noise from the environment to the ears of the user.

These and other features and advantages of the invention will become more apparent with a description of the best mode of the invention and reference to the associated drawings.

DESCRIPTION OF THE DRAWINGS

FIG. 2A–2C is an exploded view of the acoustical pillow;

Figure 3:
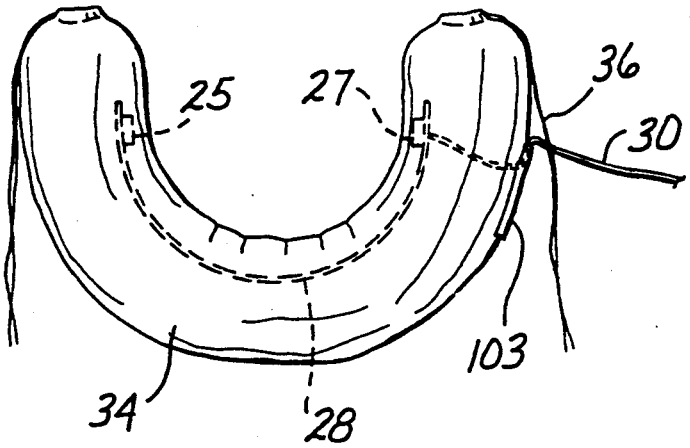
Figure 4:
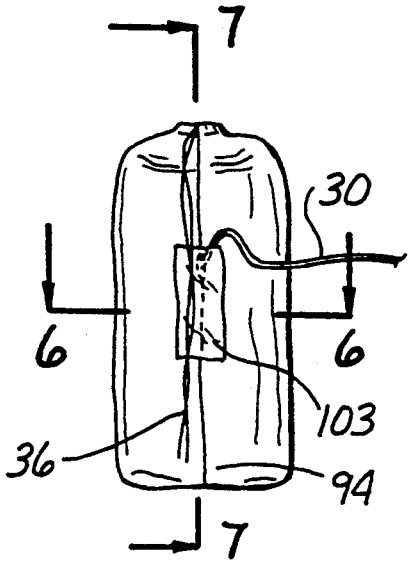
Figures 8, 9:
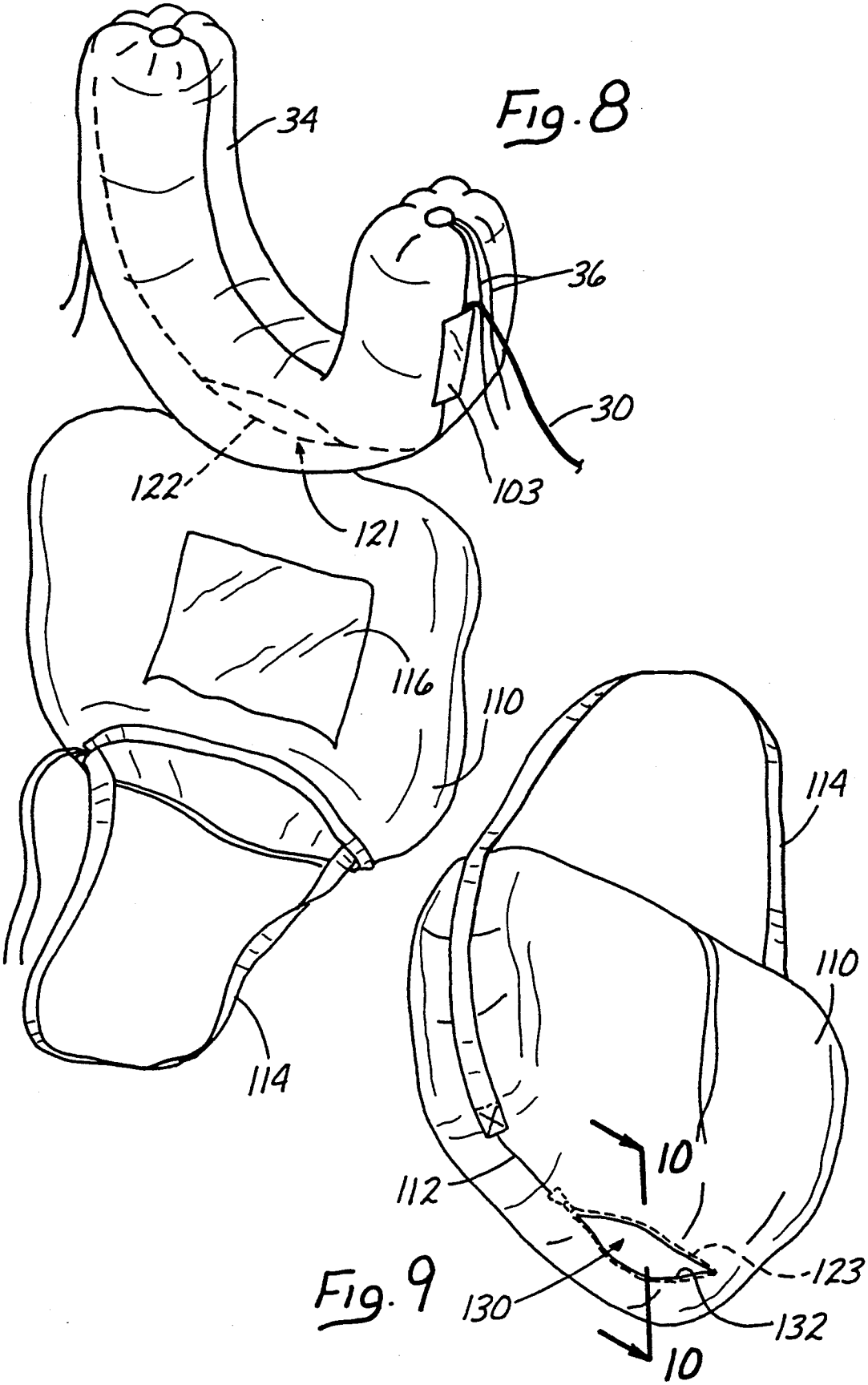

FIG. **2*a*** is a perspective view of a core of the pillow;

FIG. **2*b*** is a perspective view of a cover of the pillow;

FIG. **2*c*** is a perspective view of fiberfill surrounding the pillow;

FIG. **2*d*** is a perspective view of a pillow case associated with the pillow;

FIG. **2*e*** is a perspective view of an optional everting tote bag for the pillow;

FIG. 3 is a front elevation view of one embodiment of the pillow of the present invention;

FIG. 4 is a side elevation view of the pillow of FIG. 3;

FIG. 5 is a top view of the pillow of FIG. 3;

FIG. 6 is a cross-section view taken along lines 6—6 of FIG. 4;

FIG. 7 is a cross-section view taken along lines 7—7 of FIG. 4;

FIG. 8 is a perspective view of an embodiment including the pillow and the tote bag;

FIG. 9 is a perspective view of the tote bag extending through an opening in the pillow case and enveloping the pillow; and FIG. 10 is a cross-section view of the opening taken along lines 10—10 of FIG. 9.

DESCRIPTION OF PREFERRED EMBODIMENTS

Figure 1:
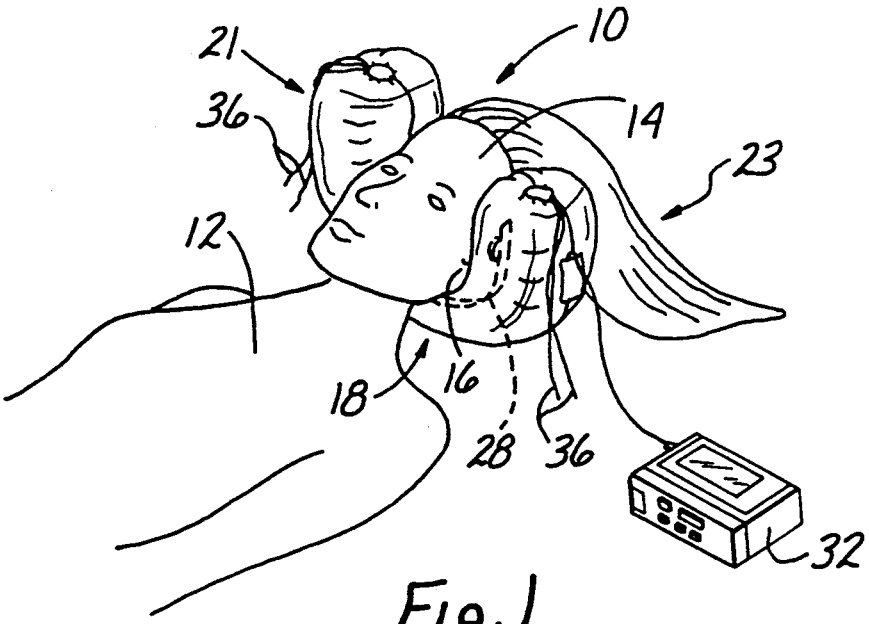
FIG. 1 is a perspective view of the acoustical pillow of the present invention connected to a tape player and supporting the head of a user.

An acoustical pillow is illustrated in FIG. 1 and designated generally by the reference numeral 10. The pillow 10 is shown in use by a person 12 having a head 14 and a pair of ears 16. The pillow 10 includes a center section 18 and a pair of end sections 21 and 23. These end sections 21 and 23 are disposed on opposite sides of the central section 18 and are bent therefrom in a common direction so that the pillow 10 has a generally U-shaped configuration.

With the pillow 10 formed in this manner, it is particularly adapted to support the head 14 in a relaxed elevated position so that the spine of the person 12 is correctly positioned to facilitate rest or sleep. With the head 14 resting on the center section 18 of the pillow, the end sections 21 and 23 engage the sides of the head 14 thereby maintaining it in a comfortable position squared with the shoulders of the user.

These end sections 21 and 23 snugly engage the ears 16 to attenuate any environmental sounds which might otherwise interfere with rest. Thus the pillow 10 facilitates relaxation by providing a soft supporting surface, by positioning the head 14 and spine with correctness and ease, but also by acoustically quieting the sleep environment. A spring 28 may also be provided to extend through the center section 18 and bias the end sections 21 and 23 into a snug fit against the ears 16 of the person 12. The pillow 10 can be provided with a pair of speakers 25 and 27, best shown in FIG. 3, which can be connected through a conductor 30 to an audio source such as a cassette or compact disc player 32. The pillow 10 may also include a pillow case 34 which is closed in the illustrated embodiment by a pair of draw strings 36.

The construction of the pillow 10 will be more apparent with reference to the exploded view of FIG. 2. With more specific reference to FIG. 2*a*, this embodiment of the pillow 10 is illustrated to include a core 41 which is cut in the U-shaped configuration from a soft compliant material such as foam rubber. In a preferred method of manufacture, the core 41 is cut from a block of foam rubber which is four inches thick, twelve inches long and eight inches wide. The center section 18 of the core 41 extends generally along the length of the foam block while the end sections 21 and 23 extend generally along the width of the foam block.

After cutting, as illustrated in FIG. 2*a*, the core 41 in this embodiment has a top surface 43, a bottom surface 45, a side surface 47, and two end surfaces 50 and 52. Each of these surfaces 43–52 comprise outer surfaces in that they face away from the interior of the U-shaped core 41. An inner surface 54 is the only surface which faces inwardly of this U-shaped configuration. With this shape, the core 41 can be described as having an elongate configuration extending along an axis 61 where the end sections 21 and 23 are bent along the axis 61 in a common direction.

In a preferred embodiment, a cross-section taken perpendicular to the axis 61 may have a uniform rectangular configuration, a separation of about six inches between opposing ends of the inner surface 54 provides each of the end sections 50, 52 with a rectangular configuration and dimensions of three inches by four inches in this particular embodiment. The end surfaces 50, 52 will typically be formed in a common plane while the surfaces 43 and 45 will be generally parallel. The inner surface 54 and side surface 47 are curved but have similar shapes so that these surfaces also have a generally parallel relationship in this embodiment.

It is to be understood that these relationships of the surfaces and the specific dimensions disclosed for this particular embodiment, may vary widely within the concept of the invention which benefits primarily from the U-shaped configuration of the core 41.

After the core 41 has been formed, a slit 65 can be cut in the core 41 to receive the speakers 25 and 27 previously discussed. In a preferred embodiment, this slit extends between the axis 61 inwardly toward and generally perpendicular to the surface 54. In this case, the slit 65 has a generally planar configuration and is disposed intermediate between and generally parallel to the surfaces 43 and 45. With this configuration, the slit 65 is particularly adapted to receive the spring 28 and/or the speakers 25, 27.

In addition to the slit 65, a slot 67 can be formed in the plane of the slit 65 to extend entirely across one of the end sections, such as the end section 23. Communicating with the slit 65, the slot 67 provides a channel through which the conductor 30 can be laid to engage the speakers 25 and 27 in the slit 65 while exiting the pillow 10 through the slot 67 at the side surface 47.

After the core 41 has been formed and the spring 28 and/or speakers 25, 27 have been positioned within the slit 21, the core 41 can be covered by a layer of fiberfill 70 best illustrated in FIG. 2*b*. In a preferred embodiment, a 24 inch by 30 inch sheet of nine ounce fiberfill is wrapped around the center section 18 and up the side sections 21 and 23 of the core 41. Importantly, the layer of fiberfill 70 overlaps itself in proximity to the inner surface 54 as shown by the arrow 72 in FIG. 2*b*. In this location the overlapping fiberfill 70 adds softness and compliance to the area which supports the head 14 of the person 12.

After the core 41 has been wrapped with the fiberfill 70, this combination can be compressed and loaded into a cover 76, best illustrated in FIG. 2*c*. In a preferred embodiment, the cover 76 is sewn from one piece of a polycotton batiste material. This piece of material can be sewn along a seam 79 into the configuration of a tube 78 where the ends of the tube are closed by generally circular end panels 81 and 83. A reinforced hole 85 can be formed in the tube 78 to enable the conductor 30 to exit the cover 76. The core 41 and fiberfill 70 are most easily loaded into the cover 76 by leaving an opening 87 in the seam 79 at the center section 18. This opening 87 can be hand sewn to complete the cover 76.

As a final step in the manufacturing process, the core 41, fiberfill 70 and cover 76 can be loaded into the pillow case 34. This pillow case 34 will typically be configured not only for its structural features but also its aesthetic appearance. Thus in a preferred embodiment, the pillow case 34 is formed in the configuration of a tube 90 by joining two pieces of colorful material along an inner seam 92 and an outer seam 94. These two seams 92 and 94 in a preferred embodiment lie in a common plane with the axis 61 and the slit 65 associated with the core 41.

The tube 90 of the pillow case 34 has a generally constant circumferential dimension between its ends 96 and 98 which are preferably left open to facilitate loading the core 41 into the case 34. These ends 96 and 98 are circumferentially hemmed and the drawstrings 36 are laced through the hems in a conventional manner. By pulling the drawstrings 36, the ends 96 and 98 of the case 34 can be gathered around the end sections 21 and 23 of the core 41.

A opening 101 can be left in the outer seam 94 of the pillow case 34 to provide an exit for the conductor 30. It may also be desirable to provide one or more pockets 103 on the outside of the case 34 to accommodate storage of the conductor 30 and perhaps the audio player 32 when the pillow 10 is not in use. In a preferred embodiment, the pocket 103 is formed over the exit hole 101 so that the conductor 30 cannot be seen when it is stored in the pocket 103.

In a further embodiment of the invention, a tote bag 110 is provided to receive the pillow 10. In a preferred embodiment, the tote bag 110 is formed from two pieces of material which are partially joined at their perimeters along a seam 112. A handle in the form of a shoulder strap 114 can be attached to the bag 110 along the seam 112. A storage pocket 116 may also be provided on the inside of the bag 110.

In a preferred embodiment, the pillow case 34 is provided with an opening 121, best shown in FIG. 8, along the outer seam 94 in the vicinity of the center section 18 This opening 121 which is defined by edges 122, is provided with a zipper which alternatively closes or opens the opening 121.

The tote bag 110 is also provided with an opening 130 in the seam 112. In a preferred embodiment, the tote bag 110 is permanently attached to the pillow case 34 at the respective openings 130 and 121. Thus the edges 132 of the opening 130 are sewn to the edges 122 of the opening 121. Importantly, the edges 132 are sewn to the edges 122 interiorly of the pillow case 34 and the zipper 123. With this configuration the tote bag 110 can be stuffed through the opened zipper 123 and the opening 121 to reside within the pillow case 34 in a stored position, when the pillow 10 is in use. When the pillow is no longer being used, the zipper 123 can be opened to permit the tote bag 110 to be withdrawn from the pillow case 34. From this position, illustrated in FIG. 8, the bag 110 can be turned inside out or everted over the pillow 10 as illustrated in FIG. 9. In this tote position, the zipper 123 is hidden and the opening 121 remains open.

In the foregoing description, the spring 28 has been mentioned only briefly but may be of particular interest to several embodiments of the invention. This spring 28 which will typically be a leaf spring, may be formed from plastic, metal or any other material providing the desired spring characteristic. The spring will be formed in the U-shaped configuration with its ends biased toward a closed relationship rather than an open relationship. When disposed within the core 41, these characteristics of the spring 28 will bias the end sections 21 and 23 of the core toward each other to provide the desired snug engaging fit with the ears 16 of the person 12. In a particular embodiment, it may be desirable that the slit 65 not extend in the direction of this spring bias. In such a case, a slit could be provided to extend toward the axis from either the top surface 43, the bottom surface 45 or the side surface 47. The slit 65 discussed with reference to FIG. 2*a* seems to be best suited for an embodiment which includes both the spring 28 and the speakers 25 and 27. In such an embodiment, the speakers 25 and 27 may be mounted on the ends of the spring 28 to form a subassembly which can be loaded directly into the slit 65.

These are just a few of the many variations on the foregoing concept which are all deemed to be within the scope of the invention. Other variations in the types of material, the location of seams, and the types of closure mechanisms will be readily apparent to those skilled in the art.

Given these wide variations, which are all within the scope of this concept, one is cautioned not to restrict the invention to the embodiments which have been specifically disclosed and illustrated, but rather encouraged to determine the scope of the invention only with reference to the following claims.

I claim:

1. A pillow adapted to support the head of a user, comprising:
- a core having an axis extending through a central section and opposing end sections;
- the central section having a thickness adapted to support the head of a user with the spine of a user disposed in a cervically correct configuration, the central section having a length generally equivalent to the width of the head of the user;
- the end sections being bent from the central section along the axis of the core, and being generally coextensive in a common direction to provide the core with a generally U-shaped configuration;
- the central section and end sections having an outer surface and an inner surface;
- portions of the core defining a slit extending from one of the surfaces into the core;
- a spring disposed in the slit and extending through the central section and into each of the end sections;
- the spring having properties for biasing the end sections toward each other to provide a snug fit relationship with the ears of the user; whereby
- the end sections tend to attenuate environmental sound by isolating the ears of the user from the environment.

2. The pillow recited in claim 1 wherein the pillow is adapted for use with a source of audio signal and further comprises:
- a speaker disposed in the slit of each end section in close proximity to the inner surface; and
- a conductor adapted to engage the source and to transmit the audio signal through the slit to each of the speakers.

3. The pillow recited in claim 2 wherein the speakers are attached to the spring.

4. The pillow recited in claim 1 further comprising:
- a pillow case surrounding the core of the pillow; and
- a tote bag permanently attached to the pillow case, the tote bag having a stored position within the pillow case and a tote position everted from the pillow case for carrying the core and the pillow case.

5. The pillow recited in claim 1 wherein the slit extends from the inner surface toward the axis of the core.

6. A pillow adapted to support the head of a user and to be used with a source of audio signal, comprising:
- a solid, resilient core having an axis extending through a central section and opposing end sections;
- the central section having a thickness adapted to support the head of a user with the spine of a user disposed in a cervically correct configuration, the central section having a length generally equivalent to the width of the head of the user;
- the end sections being bent from the central section along the axis of the core, and being generally coextensive in a common direction to provide the core with a generally U-shaped configuration to snugly engage the sides of the head of the user, proximate the ears of the user;

the central section and end sections having an outer surface and an inner surface;

portions of the core defining at least one slit extending from one of the surfaces into the core;

a speaker disposed in the slit in close proximity to the inner surface; and a conductor adapted to engage the source and to transmit the audio signal through the slit to the speaker.

7. The pillow recited in claim 6 further comprising:

a spring disposed in the slit and extending through the central section and into each of the end sections; and the spring having properties for biasing the end sections toward each other to provide a snug fit relationship between the speaker and the ear of the user.

8. The pillow recited in claim 6 further comprising:

portions defining a slot extending across one of the end sections and communicating with the slit; and the conductor extending from the speaker through the slit and the slot to exit the pillow for external connection to the source of audio signal.

9. The pillow recited in claim 6 further comprising:

a pillow case surrounding the core of the pillow; and a tote bag permanently attached to the pillow case, the tote bag having a stored position within the pillow case and a tote position everted from the pillow case for carrying the core and the pillow case.

* * * * *